United States Patent [19]

Korson

[11] 4,089,358

[45] May 16, 1978

[54] INFLATABLE CONTAINER

[76] Inventor: Brian Korson, 81 Ranee Avenue, Toronto, Ontario, Canada, M6A 1N1

[21] Appl. No.: 756,771

[22] Filed: Jan. 5, 1977

[51] Int. Cl.[2] ..... B65D 37/00

[52] U.S. Cl. ..... 150/.5

[58] Field of Search ..... 150/.5, 48, 49; 4/172, 4/177; 206/218; 220/8

[56] References Cited

U.S. PATENT DOCUMENTS

| | | | |
|---|---|---|---|
| 993,174 | 5/1911 | Kidd | 150/49 |
| 2,886,084 | 5/1959 | Davison | 150/.5 |
| 3,319,685 | 5/1967 | Urban | 150/52 R |

*Primary Examiner*—Donald F. Norton

[57] ABSTRACT

An inflatable container is disclosed comprising a substantially flexible outer wall and inner wall defining an inflatable envelope, the inner and outer wall terminating in a bottom wall member. A first collar extends around the periphery of the upper portion of the outer wall and a second collar extends around the periphery of the bottom section of the outer wall. The first and the second shoulder are releasably securable to one another through a cap member. The envelope has an openable and a closable opening therein for inflating and deflating the container.

4 Claims, 4 Drawing Figures

INFLATABLE CONTAINER

SUMMARY OF THE INVENTION

The present invention relates to an inflatable container comprising a substantially flexible outer side wall member extending into a bottom wall member and a substantially flexible inner side wall member extending into such bottom wall member. The outer wall member and the inner wall member define an envelope therein for receiving a fluid to inflate the container from a substantially fully collapsed configuration to a substantially fully extended configuration. A first collar member extends around the upper periphery of the outer side wall, the first collar member having first securing members thereon. A second collar member extends substantially around the bottom periphery of the outer side wall the second collar having a second securing member thereon. The first securing member is releasably securable to the second securing member through a cap member which engages both collars when the envelope is deflated.

A sealable opening extends into the envelope for inflating and deflating the container. The bottom wall member may comprise a first bottom wall secured to the bottom periphery of the inner wall member and a second bottom wall secured to the inner periphery of the outer wall member.

The first securing member may comprise a first detent member and the second securing member may comprise a second detent member the cap engaging with detents when the cup is deflated. The first detent may comprise a first flange extending outwardly from the first collar away from the outer wall and then towards the outer wall member. The second detent may comprise a second flange extending outwardly around the second collar away from the outer wall and then towards the outer wall.

The first flange and the second flange may extend away from and then towards the outer wall each in a V-shaped cross-section, the apex of the first flange and the apex of the second flange nestably receivable by corresponding sections in the cap.

The sealable opening member may comprise an opening in the envelope, an open tube extension projecting from the periphery of the opening, a plug member insertable in the tube for sealing the tube.

The tube may be sufficiently flexible to be turned inside out for insertion into the envelope and for extending out of the envelope and may taper inwardly from the opening to the end of the tube.

The envelope may extend between the first and second bottom wall member and the two may be positioned in an opening in the second bottom wall member.

BRIEF DESCRIPTION

Figure 1:
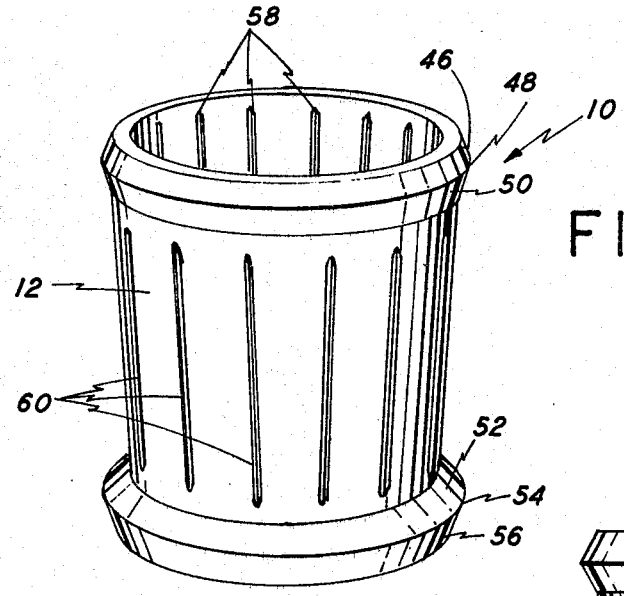
FIG. 1 comprises a perspective view of an inflatable container.

Flexible containers or inflatable containers are disclosed in the prior art U.S. Pat. Nos. Tytel 3,631,544; Valtri, et al., 3,434,589; Urban 3,319,685; Cushman 3,006,396; Lewis 3,002,646 and Groshloz 21,955.

One of the objects of the present invention is to provide a novel inflatable container in which the upper and lower periphery thereof are substantially rigid in order to facilitate use of the container as a drinking receptacle such as a cup and the like or a bowl and the like and in which the upper and lower periphery thereof are releasably joinable to one another.

These and other objects have been achieved according to the present invention and will become apparent by reference to the disclosure and claims that follow as well as the appended drawing.

Referring to the drawing and FIGS. 1–4 therein, an inflatable container such as an inflatable cup 10 is illustrated having a substantially flexible outer wall 12 extending into a bottom wall 16. Outer wall 12 continues as a substantially flexible inner wall 14 having a bottom wall 18 extending from the bottom periphery thereof. An inflatable envelope 20 is formed between the outer wall 12 and the inner wall 14, the bottom walls 18 and 16 also forming a part of the inflatable structure. The upper periphery of the outer wall extends in a collar-like projection comprising a flange 46 which extends away from the outer wall 12 and then inwardly at apex 48 as an inwardly projecting flange 50 which continues as part of the outer wall 12. Similarly, the bottom periphery of outer wall 12 comprises a collar which extends as a flange 56 projecting away from outer wall 12 to apex 54 and then inwardly as flange 52 projecting towards the outer wall 12. A plurality of ribs 60 are arranged vertically on the outer surface of wall 12 and function to provide some reinforcement for the container 10 and also to act as a non-slip gripping surface. Similarly flexible reinforcing ribs 58 are arranged on the inner surface of inner wall 14. A cap 30 having a top 37 and walls 30A and 31 forming a V-cross section to mate with the walls 46 and 50 of the collar extending from the outer wall 12 is provided, the cap further extending into a flange-like projection 32 which extends away from the outer wall 12 and then projects inwardly at apex 34 towards the outer wall 12 as flange 36. Similarly, a cap 45 having end wall 47 and side walls 39 and 38 which are received by the bottom collar walls 56 and 52 is provided, the cap further extending into a flange 40 projecting away from the outer wall 12 and then projecting at apex 42 inwardly towards outer wall 12 as flange 44. In one embodiment, either cap 30 or cap 45 may be employed in combination with the container 10 or both caps may be employed. Where both caps 30 and 45 are used, the apex 34 of cap 30 is nestable in the apex 42 of cap 45. Where a single cap such as cap 30 is employed, the apex 54 of the bottom collar of the container is nestable in the apex 34 of cap 30 and the apex between the walls 30A and 31 of cap 30 is also arranged to receive th apex 54 when cap 30 is used on the bottom of the cap.

An opening 22 is provided in the envelope 20 in the bottom wall 16 and a neck 26 extends from the periphery of the opening. Neck 26 is sufficiently long so that upon inflation of the envelope 20, neck 26 may be pinched off prior to insertion of the plug 24 therein. Both the inner and outer surfaces of neck 26 have horizontal ridges therein as does plug 24 which is insertable into opening 22 and received in neck 26 so that plug 24 may be secured in neck 26.

Figure 2:
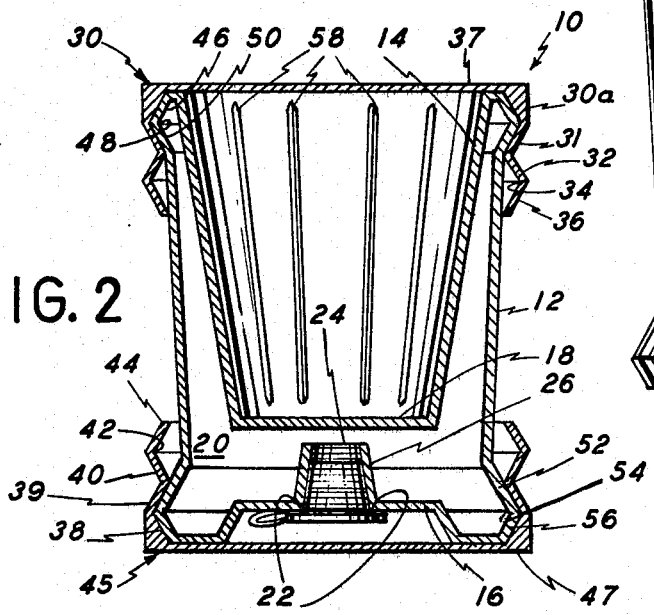
FIG 2 comprises a side elevation in section as described in FIG. 1 and further illustrates an opening member and a plug member insertable therein through which the flexible container may be inflated and deflated.
Figure 4:
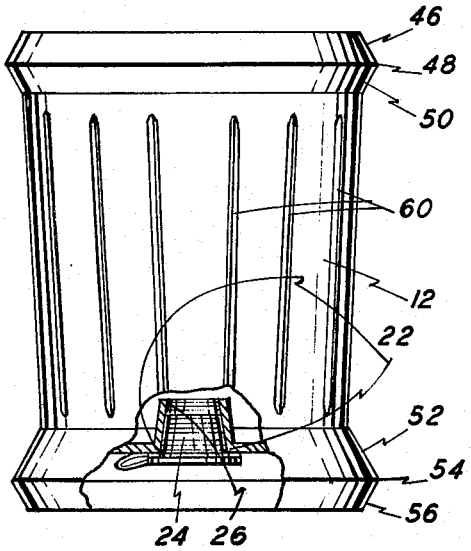
FIG. 4 comprises a side elevation partially in section illustrating the inflatable container as described with respect to FIG. 1 and in which the opening and plug member are illustrated.
Figure 3:
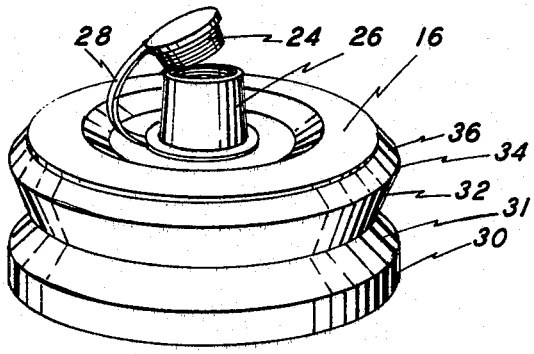
FIG. 3 comprises a perspective view of an inflatable container as described in FIG. 1 in which the container is collapsed and the collar members are secured one to the other according to another embodiment of the present invention.

Neck 26 is also sufficiently flexible so that it may be turned inside out for presentation as is illustrated in FIG. 3 for inflation of the envelope 20 and upon inflation to be positioned as is illustrated in FIGS. 2 and 4 inside of the envelope 20. Plug 24 is secured to the base of the opening 22 by means of a flexible tab 28.

In use, the neck 26 is positioned as is illustrated in FIG. 3 and the plug 24 removed therefrom. The lid or cap 30 is removed from the bottom collar of the side walls 12 and a fluid such as air is introduced into the envelope 20 until the envelope 20 is fully erect as is illustrated in FIGS. 1, 2 and 4. The plug 24 is then inserted in the neck 26 and the neck 26 turned inside out to face into the envelope 20 as is illustrated in FIGS. 2 and 4. A cap, such as the cap 45 may be positioned over the bottom of the container 10 in order to contribute to the rigidity of the bottom of the cap and alternately a cap 30 may be placed over the top of the container 10 to prevent liquid spills. When the container 10 is no longer used, the plug 24 may be removed from the neck 26 to deflate the envelope 20 after which the upper collar and the bottom collar of the container may be secured one to the other either through the caps 30 and 45 so that the flange 32 and 36 engages the flange 44 and 40 or alternately, a single cap 30 may be employed so that the flange 32 and 36 engages the flange 52 and 56 of the bottom collar of the container 10.

Although the invention has been described by reference to some embodiments, it is not intended that the novel inflatable container be limited thereby, but that modifications thereof are intended to be included as falling within the broad spirit and scope of the foregoing disclosure the following claims and the appended drawing.

What is claimed is:

1. An inflatable container apparatus comprising a substantially flexible outer side wall extending into bottom wall means for forming the base of said container, a substantially flexible inner side wall extending into said bottom wall means, said outer wall and said inner wall defining an envelope therein for receiving a fluid to inflate said container from a substantially fully collapsed configuration to a substantially fully extended configuration, a first collar extending around the upper periphery of said outer side wall, a second collar extending around the bottom periphery of said outer side wall, cap means for cappingly engaging said first collar and said second collar, said first collar extending outwardly away from said outer wall and then towards said outer wall in a V-cross section, said second collar extending outwardly away from said outer wall and then towards said outer wall in a V-cross section, said first collar being securable and releaseable from said second collar through said cap means, a V-cross section corresponding to each of the cross sections of the first and second collars extending around the periphery of said cap means, the apex of said first collar and the apex of said second collar being receivable by the V-cross section of said cap means, said first collar releasably securable to said second collar through said cap means when said envelope is deflated, sealable opening means extending into said envelope for inflating and deflating said container.

2. The apparatus of claim 1 where said bottom wall means comprises a first bottom wall secured to the bottom periphery of said inner wall and a second bottom wall secured to the inner periphery of said outer wall.

3. The apparatus of claim 2 where said envelope extends between said first and said second bottom wall, said sealable opening means comprises an opening in said second bottom wall, an open tube extension projecting from the periphery of said opening, plug means insertable in said tube for sealing said tube.

4. The apparatus of claim 1 where said sealable opening means comprises an opening in said envelope, an open tube extension projecting from the periphery of said opening, plug means insertable in said tube for sealing said tube.

* * * * *